US011028743B2

(12) United States Patent
Naclerio

(10) Patent No.: US 11,028,743 B2
(45) Date of Patent: Jun. 8, 2021

(54) ROAD VEHICLE WITH AN INTERNAL COMBUSTION ENGINE AND PROVIDED WITH AN EXHAUST NOISE TRANSMISSION DEVICE

(71) Applicant: FERRARI S.p.A., Modena (IT)

(72) Inventor: Francesco Naclerio, Belluno (IT)

(73) Assignee: FERRARI S.p.A., Modena (IT)

( * ) Notice: Subject to any disclaimer, the term of this patent is extended or adjusted under 35 U.S.C. 154(b) by 526 days.

(21) Appl. No.: 15/958,303

(22) Filed: Apr. 20, 2018

(65) Prior Publication Data

US 2018/0320646 A1 Nov. 8, 2018

(30) Foreign Application Priority Data

Apr. 21, 2017 (IT) ..... 102017000044384

(51) Int. Cl.

| | |
|---|---|
| ***F01N 1/22*** | (2006.01) |
| ***F01N 1/02*** | (2006.01) |
| *F01N 1/06* | (2006.01) |
| *F02M 35/12* | (2006.01) |

(52) U.S. Cl.

CPC ..... *F01N 1/22* (2013.01); *F01N 1/023* (2013.01); *F01N 1/06* (2013.01); *F01N 1/065* (2013.01); *F01N 2490/155* (2013.01); *F02M 35/1294* (2013.01); *G10K 2210/12822* (2013.01)

(58) Field of Classification Search

CPC ..... F01N 13/10; F01N 1/06; F01N 2490/155; F01N 1/22; F01N 1/023; F01N 13/008; F01N 2900/1404; F01N 1/065; G10K 11/22; G10K 2210/12822; F02M 35/1294

See application file for complete search history.

(56) References Cited

U.S. PATENT DOCUMENTS

| | | | | |
|---|---|---|---|---|
| 7,556,123 | B2 * | 7/2009 | Ido | F01N 1/023 123/184.57 |
| 9,926,896 | B2 * | 3/2018 | Nakashima | F02M 35/1294 |
| 10,436,085 | B2 * | 10/2019 | Pompucci | F01N 13/04 |
| 2015/0082771 | A1 * | 3/2015 | Odello | F02D 41/0072 60/274 |

(Continued)

FOREIGN PATENT DOCUMENTS

| | | | |
|---|---|---|---|
| DE | 10042012 | A1 | 5/2001 |
| DE | 102009041890 | A1 | 6/2011 |

(Continued)

OTHER PUBLICATIONS

Search Report issued in Italian Patent Application No. IT 201700044384, dated Nov. 27, 2017; 7 pages.

*Primary Examiner* — Forrest M Phillips

(74) *Attorney, Agent, or Firm* — Cantor Colburn LLP

(57) ABSTRACT

Road vehicle having: a passenger compartment; an internal combustion engine provided with at least one exhaust duct, which originates from an exhaust manifold and has at least one exhaust gas treatment device; and an exhaust noise transmission device provided with a transmission duct, which originates from the exhaust duct, and with a symposer device, which is arranged inside the transmission duct, is pneumatically insulating and is acoustically permeable; an inlet of the transmission duct being arranged between the exhaust manifold and the exhaust gas treatment device, hence upstream of the exhaust gas treatment device.

11 Claims, 6 Drawing Sheets

(56) References Cited

U.S. PATENT DOCUMENTS

| | | | | |
|---|---|---|---|---|
| 2017/0082009 | A1* | 3/2017 | Jang | F01N 9/00 |
| 2017/0350287 | A1* | 12/2017 | Pompucci | F01N 13/04 |
| 2019/0120112 | A1* | 4/2019 | Ito | F01N 13/008 |

FOREIGN PATENT DOCUMENTS

| | | | | | |
|---|---|---|---|---|---|
| DE | 102010005138 | A1 | | 7/2011 | |
| DE | 102010053075 | A1 | | 6/2012 | |
| EP | 1138887 | A2 | * | 10/2001 | G10K 11/22 |
| WO | WO2019180412 | | * | 9/2019 | F01N 1/06 |

* cited by examiner

ROAD VEHICLE WITH AN INTERNAL COMBUSTION ENGINE AND PROVIDED WITH AN EXHAUST NOISE TRANSMISSION DEVICE

PRIORITY CLAIM

This application claims priority from Italian Patent Application No. 102017000044384 filed on Apr. 21, 2017, the disclosure of which is incorporated by reference.

TECHNICAL FIELD

The present invention relates to a road vehicle having an internal combustion engine and provided with an exhaust noise transmission device.

The present invention finds advantageous application in a high-performance sports car without thereby losing its generality.

PRIOR ART

In a high-performance sports car, the noise of the internal combustion engine perceived inside the passenger compartment is quite relevant.

A critical component in the judgment of a high-performance sports car is the "quality" of the exhaust sound (not only in terms of intensity, but above all in terms of "pleasantness" of the sound), namely the satisfaction deriving from the use of a high-performance sports car is also significantly influenced by the "quality" of the exhaust sound. In order to actively control the exhaust sound, several high-performance sports cars have a variable geometry exhaust system, i.e. an exhaust system equipped with one or more electrically or pneumatically driven valves that allow modifying the exhaust gas path (and therefore sound) along the exhaust system. Consequently, in use, the electronic engine control unit modifies in real time the geometry of the exhaust system, always trying to offer an exhaust sound corresponding to the expectations of the vehicle users and obviously compatibly to the homologation regulations related to the exhaust noise intensity level.

Generally, turbocharged engines are penalized because the presence of the turbine along the exhaust pipe and of the compressor along the intake duct adds a filter and lowers both the exhaust and the intake noise.

Furthermore, the most recent EURO6C homologation regulations on pollutant emissions require the use of exhaust gas treatment devices that significantly penalize the noise performance, since an anti-particulate filter (called GPF, an acronym of "Gasoline Particulate Filter") is provided in series with the catalyst, even in the case of gasoline engines.

Intake noise amplification devices improving the noise perception of the internal combustion engine inside the passenger compartment have been proposed, for example as described in the patent U.S. Pat. No. 7,975,802 B2 or in the patent U.S. Pat. No. 8,127,888 B2. A known intake noise transmission device comprises an amplification tube, which originates in the intake duct between the air filter and the throttle and has an outlet opening that is free and faces the passenger compartment. Along the amplification tube it is arranged a symposer device, which is pneumatically insulating and acoustically permeable and has the function of avoiding pressure losses in the intake duct without penalizing the transmission of sound waves.

Even exhaust noise amplification devices improving the noise perception of the internal combustion engine inside the passenger compartment have been proposed, for example as described in the patent application IT 102016000057222A, in the patent application DE 102012109668A1 or in the patent application DE 10042012A1. A known exhaust noise transmission device comprises a transmission duct, which originates near the silencer outlet pipe and ends at a wall of the passenger compartment. A symposer device, arranged along the transmission duct, is pneumatically insulating and acoustically permeable and its function is preventing exhaust gas leaks through the transmission duct without penalizing the transmission of sound waves.

The patent application DE 102010053075A1 describes an internal combustion engine provided with an exhaust duct along which an exhaust gas treatment device is installed. A bypass duct, parallel to the exhaust gas treatment device and whose function is transmitting noise, is connected to the exhaust duct respectively upstream and downstream of the exhaust gas treatment device and is internally provided with a pneumatically insulating and acoustically permeable symposer device.

The patent application EP 1365120A1 describes an internal combustion engine provided with an exhaust duct along which an exhaust gas treatment device is installed. It is provided a noise transmission duct, which can originate from the exhaust pipe upstream of the exhaust gas treatment device, ends towards a passenger compartment of the vehicle and is internally provided with a pneumatically insulating and acoustically permeable symposer device.

DESCRIPTION OF THE INVENTION

The object of the present invention is to provide a road vehicle having an internal combustion engine with an exhaust noise transmission device, said road vehicle being easy and inexpensive to manufacture and being free of the aforesaid drawbacks, namely allowing the perception of a natural and pleasant exhaust noise inside the passenger compartment according to the expectations of the driver and of any passengers.

According to the present invention, a road vehicle with an internal combustion engine is provided with an exhaust noise transmission device, as claimed in the appended claims.

The claims describe preferred embodiments of the present invention forming an integral part of the present disclosure.

BRIEF DESCRIPTION OF THE DRAWINGS

The present invention will now be described with reference to the attached drawings showing a non-limiting embodiment, in which.

PREFERRED EMBODIMENTS OF THE INVENTION

Figure 1:
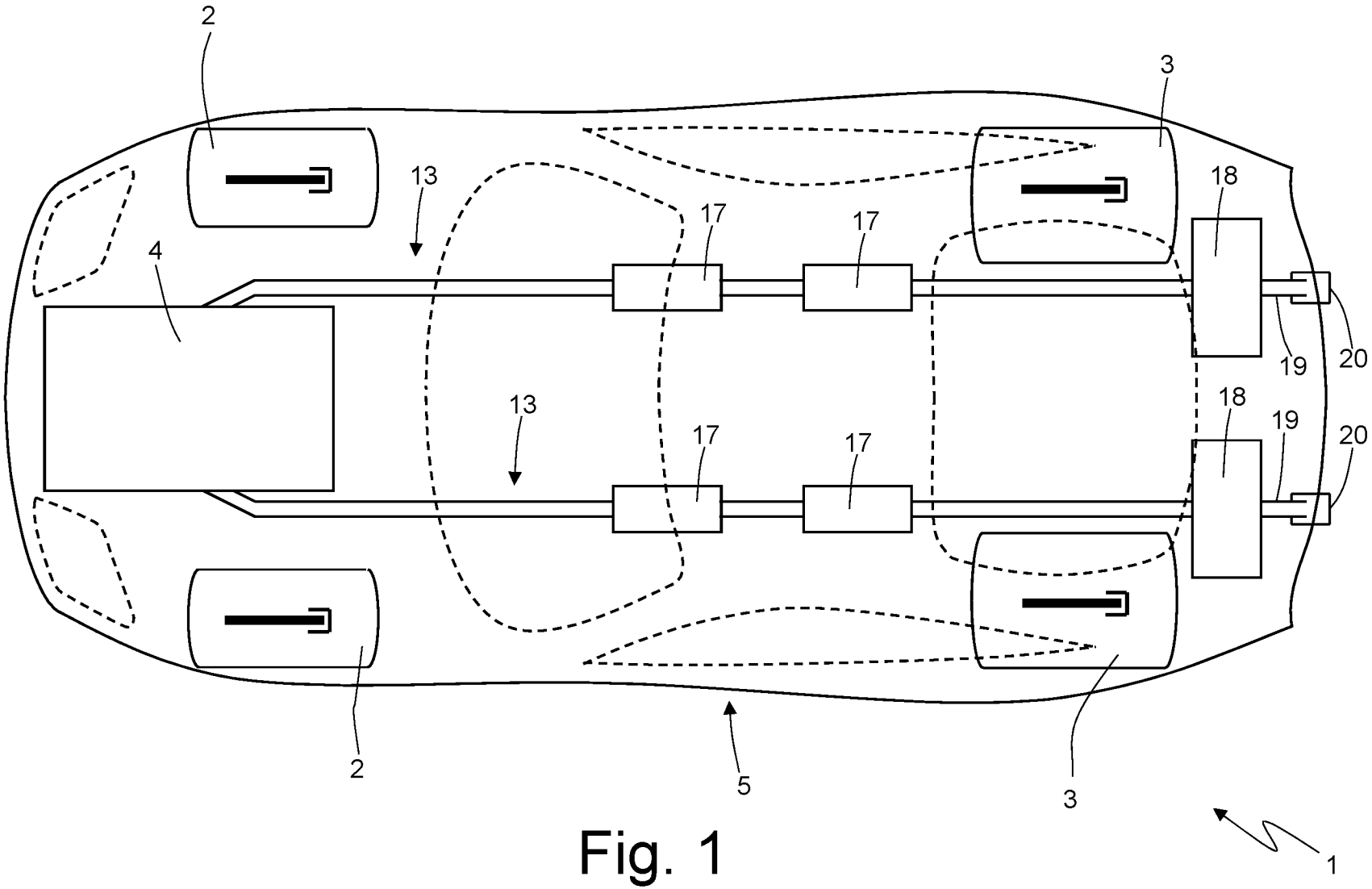
FIG. 1 is a schematic view of a car, which is manufactured according to the present invention, is operated by a supercharged internal combustion engine with two V-shaped cylinder banks and is provided with an exhaust noise transmission device.

In FIG. 1, the reference number 1 indicates as a whole a car provided with two front wheels 2 and two rear driving wheels 3, which receive the driving torque from a thermal internal combustion engine 4 supercharged by a turbocharger and arranged in a front position. The car 1 is provided with a passenger compartment 5, which can suitably house the driver and any passengers.

Figure 2:
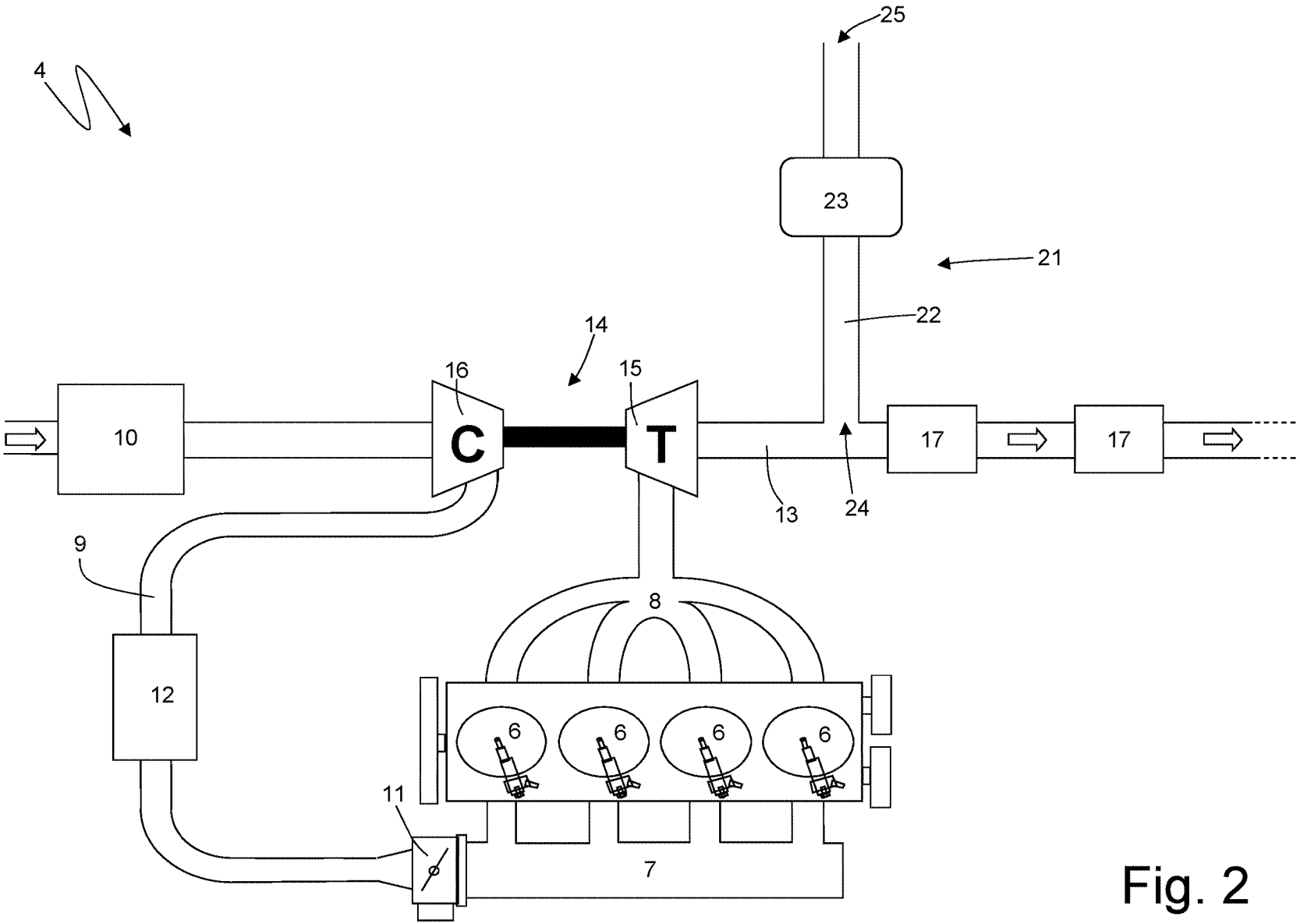
FIG. 2 is a schematic view of a bank of the supercharged internal combustion engine of the car of FIG. 1 in accordance with a first embodiment of the exhaust noise transmission device.

According to what shown in FIG. 2, the thermal internal combustion engine 4 is a "V8" and has two (twin) banks, each formed by four cylinders, mutually angled to form a "V" shape (FIG. 2 shows only one of the two cylinder banks 6 for simplicity's sake). In each bank, the four cylinders 6 are connected to an intake manifold 7 through at least one respective intake valve (not shown) and to an exhaust manifold 8 through at least one respective exhaust valve (not shown). Each exhaust manifold 8 collects the combustion gases cyclically exiting the exhaust valves. Each intake manifold 7 receives fresh air (i.e. air from the external environment) through a corresponding intake duct 9, which is provided with an air filter 10 and is regulated by a throttle 11. An intercooler 12, whose function is cooling the intake air, is arranged along each intake duct 9. A corresponding exhaust duct 13 is connected to each exhaust manifold 8, which receives the combustion gases from the exhaust manifold 8 and releases them into the atmosphere. A supercharging system of the internal combustion engine 1 comprises a pair of turbochargers 14 (only one of which is shown in FIG. 2), each of which is provided with a turbine 15, which is arranged along the corresponding exhaust duct 13 to rotate at high speed under the thrust of the exhaust gas expelled by the cylinders 3, and a compressor 16, which is arranged along the corresponding intake duct 9 to increase the air pressure supplied by the intake duct 9.

According to what better shown in FIG. 1, each exhaust duct 13 originates from the corresponding exhaust manifold 8 and ends at the tail of the car 1. Exhaust gas treatment devices 17 of known type are arranged along each exhaust duct 13: at least one catalyst is always present and even an anti-particulate filter might be present (to meet the new EURO6C regulations on pollutant emissions, the car manufacturers provide the use of an anti-particulate filter—called GPF, an acronym of "Gasoline Particulate Filter"—also in case of gasoline engines). At the end of each exhaust duct 13, a silencer 18 is provided with an outlet pipe 19, which constitutes the end part of the exhaust duct 13. An aesthetic tail 20 having only aesthetic functions (i.e. masking the outlet pipe 19 with a shape that is pleasing and consistent with the design of the car 1) is coupled to each outlet pipe 19.

As shown in FIG. 2, the car 1 comprises a pair of twin exhaust noise transmission devices 21 (only one of which is shown in FIG. 2), which are preferably, but not necessarily, symmetrical to each other. Each transmission device 21 is coupled to a corresponding exhaust duct 13 and comprises a transmission duct 22, which originates from the exhaust duct 13 and is oriented towards the passenger compartment 5 (if the exhaust noise is to be directed towards the passenger compartment) or towards the outside of the car 1 (if the exhaust noise is to be directed to the outside, particularly in the case of a convertible car). Normally, each transmission duct 22 ends at a wall of the passenger compartment 5 (e.g. at the firewall, if the exhaust noise is to be directed towards the passenger compartment 5) or at a bodywork panel (if the exhaust noise is to be directed towards the outside). Each transmission duct 22 is provided with at least one symposer device 23, which is arranged along the transmission duct 22 to seal the transmission duct 22 in a fluid-tight manner, at the same time allowing the transmission of sound (multiple symposer devices may be provided in redundant series to give a greater sealing guarantee). In other words, the symposer device 23 is pneumatically insulating (namely, it blocks the gas passage with a fluid-tight seal) and is acoustically permeable (namely, it allows the passage of sound).

In the embodiment shown in FIG. 2, each transmission duct comprises an inlet 24, which is arranged along the corresponding exhaust duct 13 (i.e. the exhaust duct 13 has a through hole where the transmission duct 22 originates) downstream of the turbine 15 of the turbocharger 14 and upstream of the exhaust gas treatment devices 17. In other words, each transmission duct 22 originates from the corresponding exhaust duct 13 between the turbine 15 of the turbocharger 14 and the exhaust gas treatment devices 17. Moreover, each transmission duct 22 has an outlet 25, which is opposite the inlet 24, is oriented towards the passenger compartment 5 and faces a wall of the passenger compartment (i.e. a panel defining the passenger compartment 5), or is oriented towards the car 1 and faces a bodywork panel. The function of each symposer device 23 is to prevent untreated exhaust gas (i.e. which has not passed through the treatment devices 17) from being released into the external environment (or, worse, inside the passenger compartment 5) and each symposer device 23 performs this function by sealing the transmission duct 22 in a fluid-tight manner. In this way, no kind of exhaust gas circulation can occur along each transmission duct 22, since the exhaust gas cannot get over the symposer device 23. Each transmission duct 22 has only acoustic functions (i.e. it has no effect on the flow of exhaust gas in the exhaust duct 13).

According to a possible but non-limiting embodiment, each symposer device 23 comprises a flexible membrane, which locally seals the corresponding transmission duct 22 and is free to deform to prevent the passage of the exhaust gas and to allow, at the same time, the transmission of sound waves. According to an alternative embodiment, each insulating element 14 comprises a rigid membrane (i.e. of rigid plastic material) and an elastic element having an annular shape (which may be flat or cup-shaped), which is arranged around the rigid membrane and is fastened to an inner wall of the corresponding transmission duct 22 to suspend the rigid membrane inside the transmission duct 22. In this way, the membrane is suspended inside the transmission duct 22 and is free to oscillate under the thrust of pressure pulsations.

According to a preferred embodiment, each symposer device 23 is entirely made of a metal material (e.g. stainless steel or aluminium) and is therefore able to withstand also the exhaust gas temperatures in the corresponding exhaust duct 13 immediately downstream of the turbine 15 of the turbocharger (approximately 400-600° C.). This embodiment requires no precaution to install each symposer device 23, since the symposer device cannot be damaged in any way by high exhaust gas temperatures.

Figure 3:
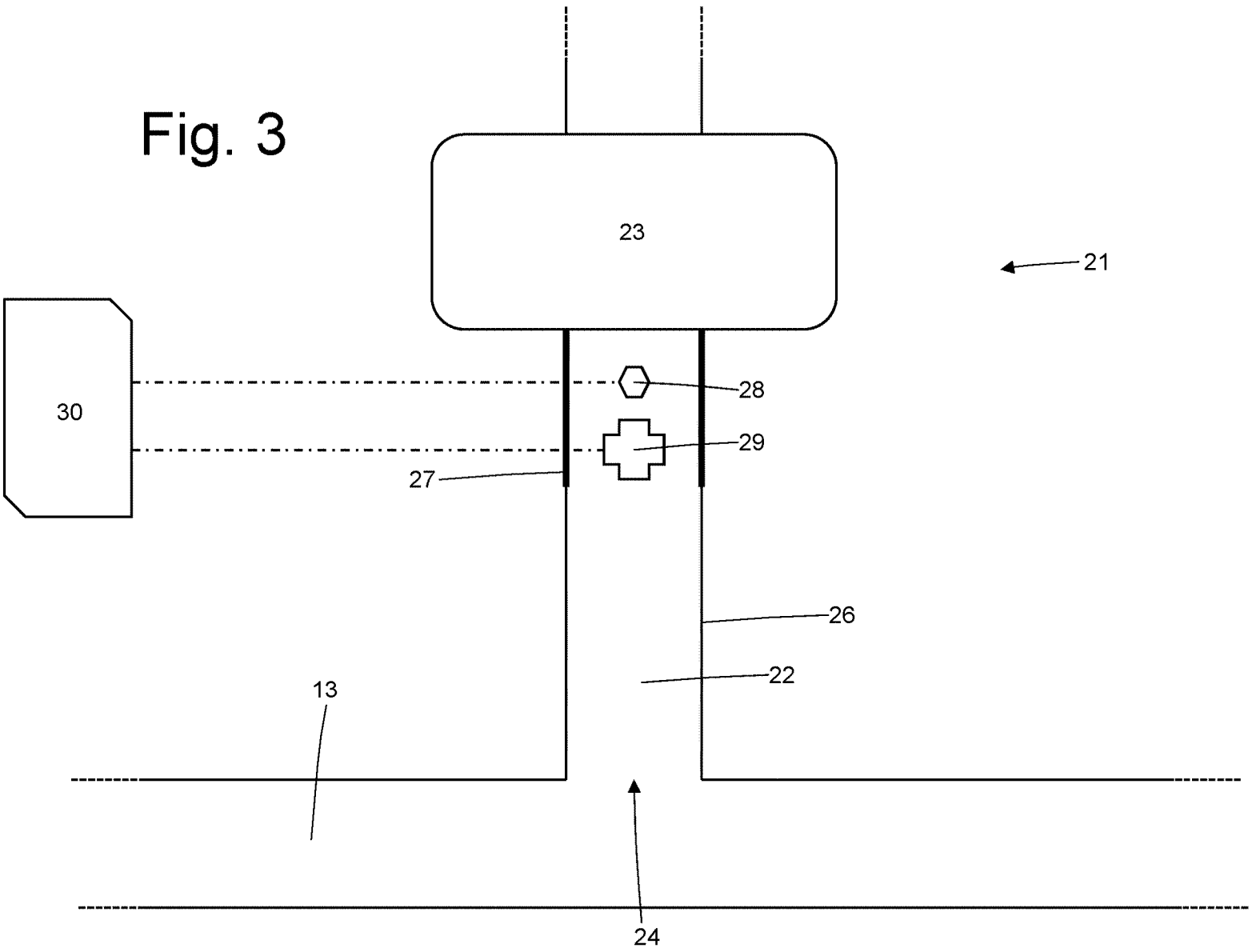
FIG. 3 is a schematic view of a possible embodiment of the exhaust noise transmission device of FIG. 2.

According to an alternative embodiment, each symposer device 23 is at least partially made of plastic material (e.g. the elastic element and/or the membrane could be made of silicone); in this embodiment, each symposer device 23 should not reach too high temperatures (e.g. not higher than 120-160° C.) to avoid any damage to the plastic parts. No exhaust gas circulation occurs along each transmission duct 22, since the transmission duct 22 is plugged by the symposer device 23 and therefore the exhaust gas inside the transmission duct 22 is stationary (static). Consequently, the exhaust gas does not appreciably heat the symposer device 23 if the symposer device 23 is sufficiently far (e.g. at least 20-30 cm away) from the exhaust duct 13. Accordingly, the symposer device 23 is essentially heated by heat conduction by the heat flowing through the wall of the transmission duct 22. According to a possible embodiment shown in FIG. 3, the transmission duct 22 comprises an initial metal part 26, which originates from the exhaust duct 13 (and is therefore subjected to higher temperatures) and a plastic insulating part 27, which is arranged in series with the initial part 26 immediately upstream of the symposer device 23. The final plastic part 27 is subjected to lower temperatures if compared to the initial part 26 (since the temperature progressively decreases along the transmission duct 22, moving away from the exhaust duct 13) and has a thermal insulating function to reduce the thermal stress of the symposer device 23. By way of example, the temperature in the exhaust duct 13 at the inlet opening 24 of the transmission duct 22 could be 600-700° C., the temperature of the transmission duct 22 at the end of the initial part 26 (i.e. at the border with the insulating part 27) could be 170-250° C., and the temperature of the symposer device 23 could be 80-100° C. The plastic material used in the symposer device 23 is selected for its elastic characteristics and is therefore less resistant to higher temperatures, while the only function of the plastic material making up the final part 27 of the transmission duct 22 is thermal insulation, so that it can be selected for its high thermal resistance.

It is essential that no exhaust gas leak occurs along each transmission duct 22, since the exhaust gas present in the transmission duct 22 has not yet been treated by the exhaust gas treatment devices 17 and any exhaust gas leak from the transmission duct 22 could reach the passenger compartment 5. In order to check the presence of any exhaust gas leak in the transmission duct 22, a temperature sensor 28 and/or a flow sensor 29 (flow meter) can be inserted along the transmission duct 22. In the absence of any exhaust gas leak along the transmission duct 22 inside the transmission duct 22, there should not be any flow (circulation) of exhaust gas. Therefore, if the flow sensor 29 detects the presence of an exhaust gas flow and/or if the temperature sensor 28 senses an increase in the temperature inside the transmission duct 22 (obviously without a corresponding temperature increase inside the exhaust duct 13), then an exhaust gas leak along the transmission duct 22 is diagnosed. In other words, it is provided a control unit 30, which senses the temperature inside the transmission duct 22 by means of the temperature sensor 28. If the temperature inside the transmission duct 22 increases (obviously without a corresponding temperature increase inside the exhaust duct 13), then the only plausible explanation is that there is a flow (circulation) of exhaust gas inside the transmission duct 22, and therefore an exhaust gas leak along the transmission duct 22 is diagnosed. Analogously, the control unit 30 detects the flow rate inside the transmission duct 22 by means of the temperature sensor 29. If the flow rate inside the transmission duct 22 is greater than zero, then an exhaust gas leak along the transmission duct 22 is diagnosed.

According to a possible embodiment, each transmission device 21 comprises (at least) a low-pass acoustic filter element (e.g. a Helmholtz resonator or a spongy body), which is arranged along the transmission duct 22 downstream of the symposer device 23.

According to a possible embodiment, each transmission device 21 comprises a regulation valve, which is arranged along the transmission duct 22 downstream of the symposer device 23 to vary the usable passage section through the transmission duct 22. Each regulation valve is, for example, a throttle and is provided with an electrically controlled actuator to be remotely controlled by an electronic control unit. Each regulation valve is movable between a closed position, in which it closes the passage (i.e. it eliminates the usable passage section) through the transmission duct 22, thus minimizing the transmission of sound along the transmission duct 22 and for example towards the passenger compartment 5, and a fully open position, in which it maximizes the usable passage section through the transmission duct 22, thus maximizing the transmission of sound along the transmission duct 22 and for example towards the passenger compartment 5. Each regulation valve may have only two positions (i.e. the closed position and the fully open position) or it may also have intermediate positions between the closed position and the fully open position.

By way of example, each regulation valve could be controlled based on the driving mode selected by the driver (e.g. increasing the perceived sound intensity inside the passenger compartment 5 when driving in sport mode and reducing the perceived sound intensity inside the passenger compartment 5 when driving in comfort mode). Furthermore, each regulation valve could be controlled based on the regime of the internal combustion engine 4 to "enhance" the perceived sound intensity inside the passenger compartment when necessary. Each regulation valve could also be controlled based on the position of the accelerator pedal to increase the perceived sound intensity inside the passenger compartment 5 when the driver presses on the accelerator pedal.

In the embodiment shown in FIG. 2, each transmission duct 22 has its own inlet 24 arranged along the corresponding exhaust duct 13 between the turbine 15 and the exhaust gas treatment devices 17 (hence downstream of the turbine 15) and has its own outlet 25 arranged out of the exhaust duct 13 and oriented towards the passenger compartment 5 or towards the outside of the car 5.

Figure 4:
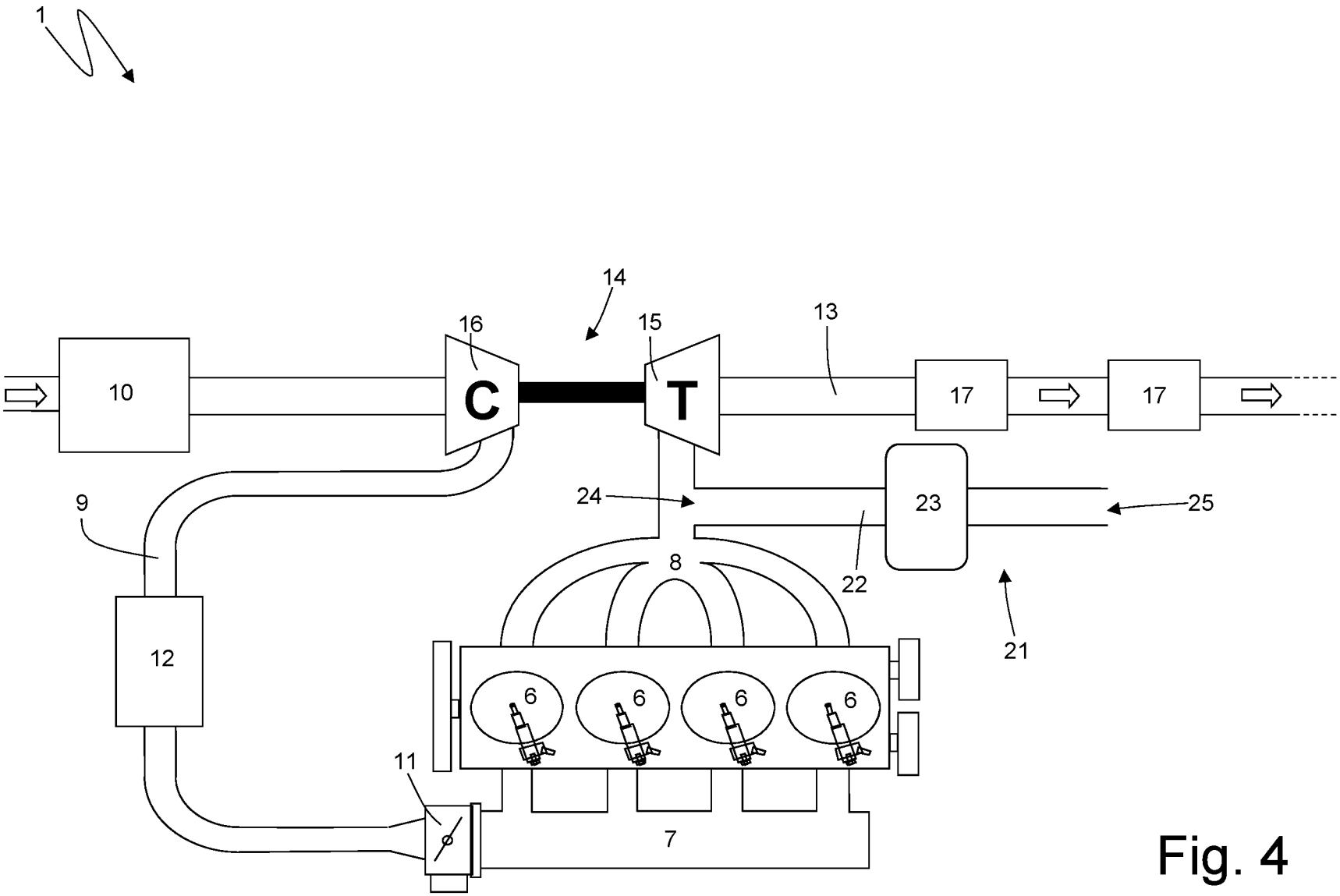
FIG. 4 is a schematic view of a bank of the supercharged internal combustion engine of the car of FIG. 1 in accordance with a second embodiment of the exhaust noise transmission device.

In the variant shown in FIG. 4, each transmission duct 22 has its own inlet 24 arranged along the corresponding exhaust duct 13 between the exhaust manifold 8 and the turbine 15 (hence upstream of the turbine 15) and has its own outlet 25 arranged outside the exhaust duct 13 and oriented towards the passenger compartment 5 or towards the outside of the car 5.

Figure 5:
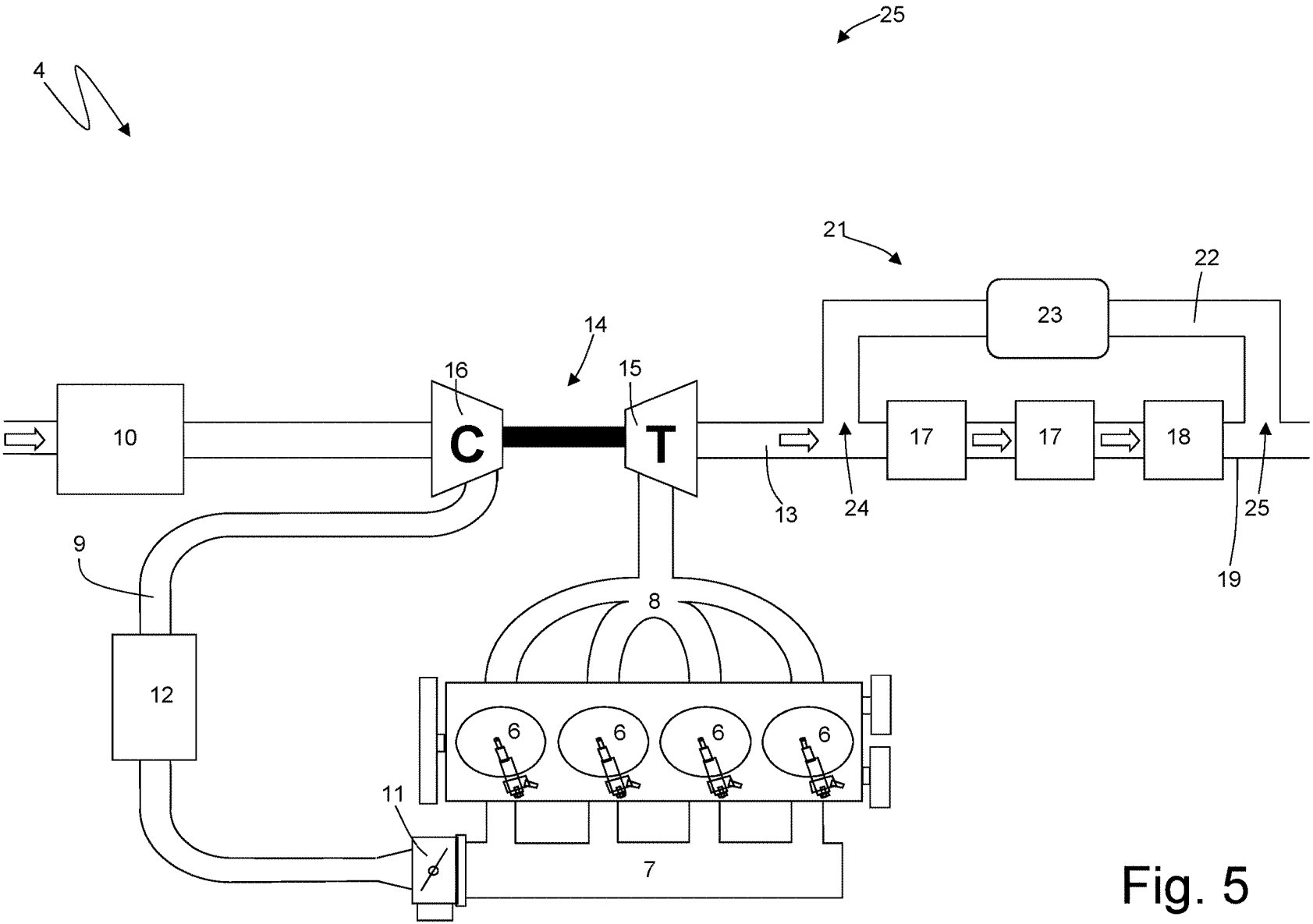
FIG. 5 is a schematic view of a bank of the supercharged internal combustion engine of the car of FIG. 1 in accordance with a third embodiment of the exhaust noise transmission device.
Figure 6:
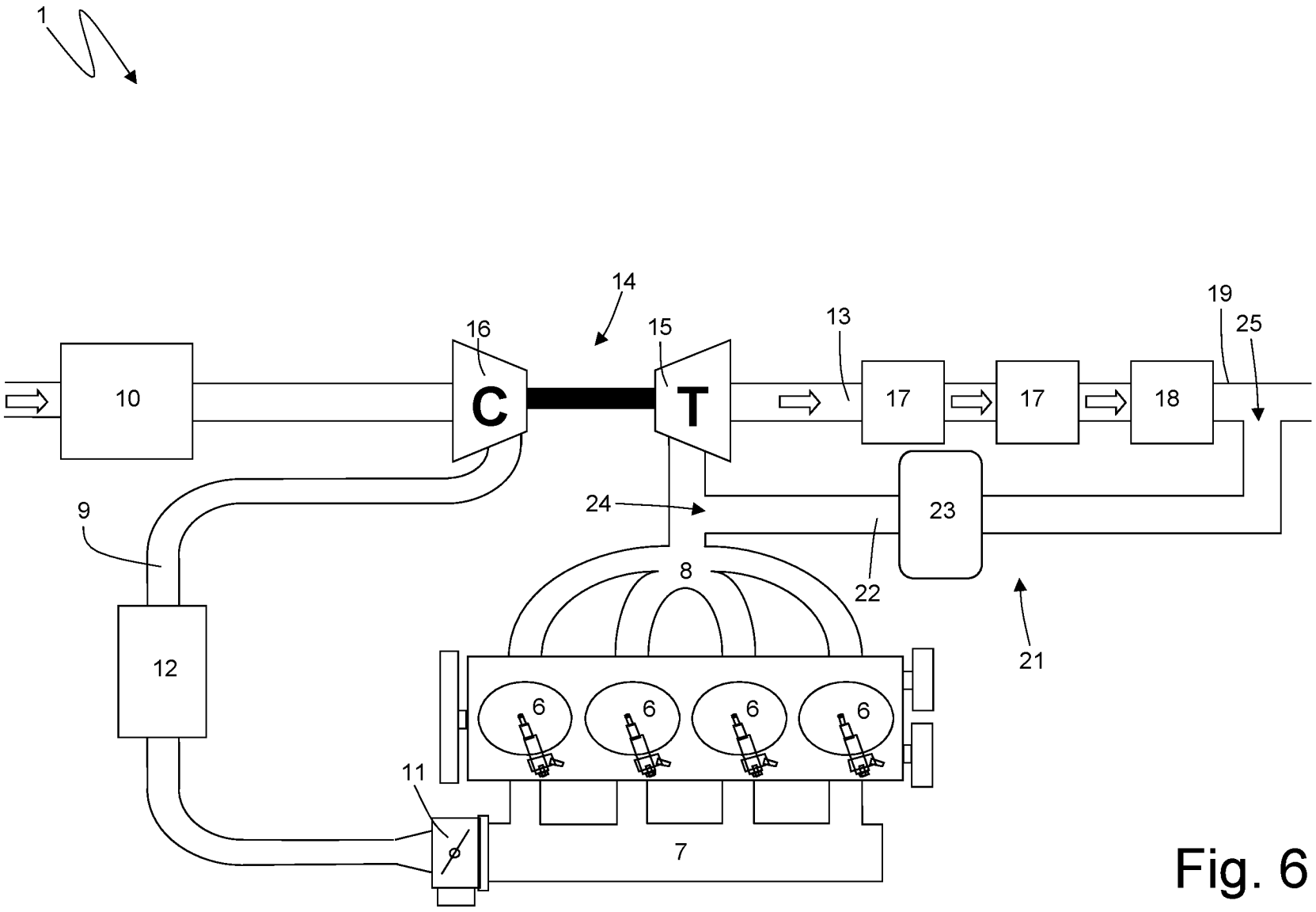
FIG. 6 is a schematic view of a bank of the supercharged internal combustion engine of FIG. 1 in accordance with a fourth embodiment of the exhaust noise transmission device.

In the variant shown in FIG. 5, each transmission duct 22 has its own inlet 24 arranged along the corresponding exhaust duct 13 between the turbine 15 and the exhaust gas treatment devices 17 (hence downstream of the turbine 15) and has its own outlet 25 arranged inside the exhaust duct 13 downstream of the exhaust gas treatment devices 17. Preferably, in this embodiment, the outlet 25 of each transmission duct 22 is also arranged downstream of the corresponding silencer 18, namely is arranged in the corresponding outlet pipe 19 (alternatively, the outlet 25 of each transmission duct 22 could being arranged between the exhaust gas treatment devices 17 and the silencer 18). In the variant shown in FIG. 6, each transmission duct 22 has its own inlet 24 arranged along the corresponding exhaust duct 13 between the exhaust manifold 8 and the turbine 15 (hence upstream of the turbine 15) and has its own outlet 25 arranged inside the exhaust duct 13 downstream of the exhaust gas treatment devices 17. Preferably, in this embodiment, the outlet 25 of each transmission duct 22 is also arranged downstream of the corresponding silencer 18, namely is arranged in the corresponding outlet pipe 19 (alternatively, the outlet 25 of each transmission duct 22 could be arranged between the exhaust gas treatment devices 17 and the silencer 18). In the embodiments shown in the attached figures, a single transmission duct 22 is coupled to each exhaust duct 13; according to an alternative embodiment not shown, each exhaust duct 13 is coupled to two or three transmission ducts 22 having corresponding inlets 24 at different points of the exhaust duct 13.

In the embodiments shown in the attached figures, the internal combustion engine 4 has eight cylinders 6 arranged in a "V" shape. Obviously, the internal combustion engine could have a different number of cylinders and/or a different arrangement of the cylinders; internal combustion engines with cylinders arranged in line (therefore with a single cylinder bank) usually have a single transmission duct 22.

In the embodiments shown in the attached figures, the internal combustion engine 4 is turbocharged; according to other embodiments not shown, the internal combustion engine 4 has no turbocharging, namely it is naturally aspirated. Each exhaust noise transmission device 21 has the function of increasing (amplifying) the exhaust noise perceived inside the passenger compartment 5 so that the overall noise generated by the internal combustion engine 4 and perceived by the occupants of the car 1 is more "pleasant", i.e. more corresponding to the wishes/expectations of the occupants of the vehicle. Therefore, the presence of the exhaust noise transmission devices 21 allows remedying the exhaust noise penalization caused by the presence of the turbines 15 and by the presence of the exhaust gas treatment devices required by the new EURO6C regulations on polluting emissions.

The presence of the exhaust noise transmission devices 21 is particularly useful in the case of turbocharged engines, since it allows exalting the exhaust noise otherwise attenuated by the turbine 15 arranged along the exhaust duct 13. Moreover, the presence of the intake noise transmission devices 21 is particularly useful in the case of turbocharging, since the presence of the compressor 16 along the intake duct 7 further attenuates (with respect to a similar intake motor) the sound level generated by the internal combustion engine 4.

The embodiments described herein may be combined without departing from the scope of protection of the present invention.

The above described car 1 provided with the exhaust noise transmission devices 21 has several advantages.

First, the exhaust noise transmission devices 21 make it possible to better direct towards the passenger compartment (and hence enhance) the exhaust noise of the internal combustion engine 4 in a way which is extremely pleasant (and therefore pleasing) to the occupants of the passenger compartment 5. This result is obtained thanks to the fact that the exhaust noise follows the natural way out and is "taken" from the exhaust ducts 13 to be (partially) transmitted towards the passenger compartment 5. In other words, the exhaust noise is not artificially "shot" towards the passenger compartment 5 through non-natural transmission channels, but, on the contrary, the exhaust noise reaches the passenger compartment 5 passing through the exhaust manifolds 8, namely following its natural way out.

Moreover, the exhaust noise transmission devices 21 are simple and inexpensive to manufacture, since each of them is essentially formed by a tube (the transmission duct 22), which is easy to manufacture and integrate into the car 1.

LIST OF FIGURE REFERENCE NUMBERS

1 car
2 front wheels
3 rear wheels
4 internal combustion engine
5 passenger compartment
6 cylinders
7 intake manifold
8 exhaust manifold
9 intake duct
10 air filter
11 throttle
12 intercooler
13 exhaust duct
14 turbocharger
15 turbine
16 compressor
17 treatment devices
18 silencer
19 outlet pipe
20 aesthetic tail
21 transmission device
22 transmission duct
23 symposer device
24 inlet
25 outlet
26 initial part of 22
27 insulating part of 22
28 temperature sensor
29 flow sensor
30 control unit

The invention claimed is:

1. A road vehicle (1) comprising:

a passenger compartment (5);

an internal combustion engine (4) provided with at least one exhaust duct (13), which originates from an exhaust manifold (8) and has at least one exhaust gas treatment device (17); and an exhaust noise transmission device (21), which is provided with at least one transmission duct (22), which originates from the exhaust duct (13), and with a symposer device (23), which is arranged inside the transmission duct (22), is pneumatically insulating and is acoustically permeable;

wherein an inlet (24) of the transmission duct (22) is arranged between the exhaust manifold (8) and the exhaust gas treatment device (18), hence upstream of the exhaust gas treatment device (18);

the road vehicle (1) being characterized in that the transmission device comprises: a temperature sensor (28) or a flow sensor (29) arranged inside the transmission duct (22); and a control unit (30) which, through the temperature sensor (28) or the flow sensor (29) diagnoses the presence of exhaust gas leaks in the transmission duct (22).

2. A road vehicle (1) according to claim 1, wherein:

the internal combustion engine (4) comprises a turbine (15), which is arranged along the exhaust duct (13) downstream of the exhaust manifold (8); and the inlet (24) of the transmission duct (22) is arranged between the turbine (15) and the exhaust gas treatment device (17), hence downstream of the turbine (15).

3. A road vehicle (1) according to claim 1, wherein:

the internal combustion engine (4) comprises a turbine (15), which is arranged along the exhaust duct (13) downstream of the exhaust manifold (8); and the inlet (24) of the transmission duct (22) is arranged between the exhaust manifold (8) and the turbine (15), hence upstream of the turbine (15).

4. A road vehicle (1) according to claim 1, wherein an outlet (25) of the transmission duct (22) is arranged outside the exhaust duct (13) and is oriented towards the passenger compartment (5) or outwards.

5. A road vehicle (1) according to claim 1, wherein an outlet (25) of the transmission duct (22) is arranged inside the exhaust duct (13) and downstream of the exhaust gas treatment device (17).

6. A road vehicle (1) according to claim 5, wherein:

the internal combustion engine (4) comprises a silencer (18), which is arranged at the end of the exhaust duct (13) and is provided with an outlet pipe (19) forming the end part of the exhaust duct (13); and the outlet (25) of the transmission duct (22) is arranged downstream of the silencer (18).

7. A road vehicle (1) according to claim 6, wherein the outlet (25) of the transmission duct (22) is arranged in the outlet pipe (19) of the silencer (18).

8. A road vehicle (1) according to claim 5, wherein:

the internal combustion engine (4) comprises a silencer (18), which is arranged at the end of the exhaust duct (13) and is provided with an outlet pipe (19) forming the end part of the exhaust duct (13); and the outlet (25) of the transmission duct (22) is arranged between the exhaust gas treatment device (17) and the silencer (18).

9. A road vehicle (1) according to claim 1, wherein the symposer device (23) is entirely made of a metal material.

10. A road vehicle (1) according to claim 1, wherein:

the symposer device (23) is at least partially made of a plastic material; and the transmission duct (22) comprises an initial metal part (26), which originates from the exhaust duct (13), and an insulating plastic part (27), which is arranged in series with the initial part (26) immediately upstream of the symposer device (23).

11. A road vehicle (1) according to claim 1, wherein the control unit (30) detects exhaust gas leaks in the transmission duct (22) if the temperature inside the transmission duct (22) increases without a corresponding temperature increase inside the exhaust duct (13) or if the flow rate inside the transmission duct (22) is greater than zero.

* * * * *